US009839298B2

(12) United States Patent
Stirling

(10) Patent No.: US 9,839,298 B2
(45) Date of Patent: Dec. 12, 2017

(54) DO IT YOURSELF BENCH

(71) Applicant: Steven O. Stirling, Nashua, IA (US)

(72) Inventor: Steven O. Stirling, Nashua, IA (US)

(73) Assignee: HAWKEYE PLASTIC PRODUCTS CO., Charles City, IA (US)

( * ) Notice: Subject to any disclaimer, the term of this patent is extended or adjusted under 35 U.S.C. 154(b) by 61 days.

(21) Appl. No.: 14/886,964

(22) Filed: Oct. 19, 2015

(65) Prior Publication Data

US 2016/0106219 A1 Apr. 21, 2016

Related U.S. Application Data

(60) Provisional application No. 62/066,614, filed on Oct. 21, 2014.

(51) Int. Cl.
*A47C 11/00* (2006.01)
*A47C 7/16* (2006.01)

(52) U.S. Cl.
CPC ..... *A47C 11/00* (2013.01)

(58) Field of Classification Search
CPC ..... A47C 11/00
USPC ... 297/440.1, 440.14, 440.15, 440.2, 440.22, 297/440.23, 440.17, 440.18, 440.19
See application file for complete search history.

(56) References Cited

U.S. PATENT DOCUMENTS 693,197 A * 2/1902 White ..... A47C 3/029 297/133
D44,562 S * 8/1913 Haase ..... 297/440.13
D46,770 S * 12/1914 Haase ..... 297/440.13
1,192,941 A * 8/1916 Schmid ..... A47C 4/02 297/277
1,674,220 A * 6/1928 Percival ..... A47C 4/02 297/440.18
2,659,422 A * 11/1953 Holland ..... A47C 5/00 297/440.13
2,960,152 A * 11/1960 Wendel ..... A47C 7/18 267/145
3,072,434 A * 1/1963 Schaefer ..... A47B 91/08 297/248
3,334,732 A * 8/1967 Haffey ..... B65D 5/001 206/503
3,527,497 A * 9/1970 Self ..... A47C 3/029 297/440.13

(Continued)

FOREIGN PATENT DOCUMENTS

JP 2006192095 A * 7/2006 ..... A47C 11/00

*Primary Examiner* — David R Dunn
*Assistant Examiner* — Tania Abraham
(74) *Attorney, Agent, or Firm* — Christopher A. Proskey; BrownWinick Law Firm

(57) ABSTRACT

An improved bench system formed of a pair of side frames having a main body portion, a front leg portion, a rear leg portion and a back portion. The side frames having a plurality of openings therein the have a flange that extend into the openings, the openings sized and shaped to receive planks from a first side and end caps from a second side. The end caps include a step that is sized and shaped to receive the flanges in the openings thereby preventing the planks from being pulled through the openings unintentionally. The benches can be themed by making the side frames one color and the end caps another color and adding an emblem to a recessed panel in the side frames. As such an improved bench that is safe and easy to assemble is presented.

19 Claims, 8 Drawing Sheets

(56) References Cited

U.S. PATENT DOCUMENTS 3,570,418 A * 3/1971 Gooding ..... A47C 4/022 108/12
3,578,385 A * 5/1971 Stiglitz ..... A47C 4/02 297/440.23
3,598,444 A * 8/1971 Seiter ..... A47C 4/022 108/64
3,663,059 A * 5/1972 Omlie ..... A47C 4/028 297/440.2
3,726,561 A * 4/1973 Bolyos ..... A47B 3/00 297/440.23
3,887,234 A * 6/1975 Curtis ..... A47C 5/12 248/188.1
3,909,064 A * 9/1975 Payne, Jr. ..... A47C 3/029 297/271.6
4,006,910 A * 2/1977 Beckley ..... A47C 4/28 297/16.1
4,077,668 A * 3/1978 Puccinelli ..... A47C 4/14 297/18
4,079,995 A * 3/1978 Beckley ..... A47C 3/00 297/440.18
4,165,902 A * 8/1979 Ehrlich ..... A47C 4/02 297/440.11
4,183,154 A * 1/1980 Dykes ..... A47C 4/02 297/440.13
4,588,227 A * 5/1986 Austin ..... A47C 4/022 297/440.11
5,332,289 A * 7/1994 Nottingham ..... A47C 3/00 248/165
5,358,309 A * 10/1994 Fedele ..... A47C 3/00 297/440.1
5,407,250 A * 4/1995 Prince ..... A47C 3/029 297/440.2
5,475,880 A * 12/1995 Guenther ..... A47K 3/122 108/67
5,613,793 A * 3/1997 Dennis ..... F16B 12/14 403/230
5,653,507 A * 8/1997 Moore ..... A47C 1/124 297/188.08
5,775,778 A * 7/1998 Riley ..... A47C 4/02 297/218.5
5,924,771 A * 7/1999 Marchesi ..... B60N 2/242 297/440.14
6,155,641 A * 12/2000 Frost ..... A47D 1/04 108/11
6,241,312 B1 * 6/2001 Watts ..... A47B 3/14 297/125
6,241,317 B1 * 6/2001 Wu ..... A47C 4/02 297/440.1
6,494,540 B1 * 12/2002 Tornero ..... A47C 31/023 297/440.1
6,619,749 B2 * 9/2003 Willy ..... A47B 3/06 108/158.12
7,066,548 B2 * 6/2006 Butler ..... B63B 29/04 114/363
7,134,728 B1 * 11/2006 Buhrman ..... A47C 3/34 297/440.14
8,393,685 B2 * 3/2013 Hill ..... A47C 11/00 297/440.13
9,565,946 B1 * 2/2017 Watton ..... A47C 7/405
2008/0023999 A1 * 1/2008 Hou ..... A47C 4/025 297/440.18
2009/0189419 A1 * 7/2009 Wu ..... A47C 4/02 297/16.2
2014/0375103 A1 * 12/2014 Lejcher ..... A47C 4/028 297/440.1
2015/0076871 A1 * 3/2015 Werner ..... A47C 9/10 297/135

* cited by examiner

DO IT YOURSELF BENCH

FIELD OF THE INVENTION

This invention relates to a bench. More specifically and without limitation, this invention relates to a do it yourself bench system, method of use, and method of manufacture.

BACKGROUND OF THE INVENTION

Benches are well known and are common fixtures in public parks, shopping malls, backyards and gardens. Countless styles and designs of benches have been developed for different applications. They serve both utilitarian purposes, such as providing a convenient and comfortable place to sit, as well as aesthetic purposes, such as decorating a park or garden. Some benches serve as memorials or commemorations to certain people or events. While many of these prior art benches are functional or aesthetically pleasing, many of these benches suffer from various problems or are undesirable for various other reasons.

As one example, many benches are unnecessarily complex, difficult and intimidating to assemble. They require the assembly of a great number of parts, require special tools, require precision cutting of parts, or other special or sophisticated processes or steps. What's worse is that if any of these parts are assembled improperly, or steps performed inadequately, the result may be a bench that cannot perform its intended task. That is, the bench may be unable to support the weight of one or more persons, thereby creating a dangerous condition.

As another example, many benches, while designed to be attractive, they suffer from design flaws such that when the bench is assembled and exposed to the elements the bench is particularly susceptible to deterioration. This deterioration detracts from the utility of the bench as the deterioration causes an unsafe condition as the elements break down the materials of the bench. In addition, this deterioration detracts from the aesthetic appearance of the bench as rust, fading, fungus growth or other discoloration or aging gives the bench an undesirable appearance. In addition, many potential users of the bench are likely to refrain from sitting on a bench that suffers from rust, fungus growth or other forms of deterioration. These design flaws may be in the choice of materials that the benches are formed of, such as using materials that quickly rust, fade, weaken or decay when exposed to the elements. Or, the design flaws may be the structural design of the bench that diminish the strength of the bench or materials that form the bench. An example of such a design flaw may be passing a fastener through the planks of the bench at or near their ends which directly expose the fastener to the elements causing premature deterioration, and may cause premature tear-out of the fastener because of its positioning at or near the end of the planks.

Another flaw in many bench designs is that they require passing a fastener perpendicularly through the exposed surface of the planks that form the seat portion and/or through the back portion of the bench. By passing a fastener through the exposed surface of the planks in this manner forms a passageway through the surface of the planks that are most exposed to the elements. This passageway encourages water to drain into the passageway where it is absorbed by the material of the planks. This moisture then promotes rotting and which substantially reduces the effective lifespan of the bench. Another drawback to this arrangement is that by passing a fastener through the exposed surfaces of the planks causes the heads of fasteners to protrude through the seat portion or back portion of the bench which limits the usefulness of the bench as it is uncomfortable to sit or lean upon the protruding heads of the fasteners. Furthermore, it is unattractive to have fasteners protrude through the visible surfaces of the seat portion and the back portion.

In addition, prior art benches have limited utility because they suffer from an inability to carry a message, to be personalized or to themed after a sports team or other cause or event.

Therefore, in view of the deficiencies in the prior art, there is a need in the art to provide an improved bench that addresses these issues.

Thus, it is a primary object of the invention to provide a bench that improves upon the state of the art.

Another object of the invention is to provide a bench that is easy to assemble.

Yet another object of the invention is to provide a bench that is safe to use.

Another object of the invention is to provide a bench that is durable over time.

Yet another object of the invention is to provide a bench that resists decay and deterioration from the elements over time.

Another object of the invention is to provide a bench that resists fading.

Yet another object of the invention is to provide a bench that is fun to assemble.

Another object of the invention is to provide a bench that is simple and not intimidating to assemble.

Yet another object of the invention is to provide a bench that uses standard parts and pieces.

Another object of the invention is to provide a bench that is appealing for do-it-yourselfers.

Yet another object of the invention is to provide a bench that can be themed after a sports team or other thing, cause or event.

Another object of the invention is to provide a bench that is inexpensive to manufacture.

Yet another object of the invention is to provide a bench that has an intuitive design.

Another object of the invention is to provide a bench that can be personalized.

Yet another object of the invention is to provide a bench that has a long useful life.

Another object of the invention is to provide a bench that is a fun project to assemble.

These and other objects, features, or advantages of the present invention will become apparent from the specification and claims.

SUMMARY OF THE INVENTION

An improved bench system formed of a pair of side frames having a main body portion, a front leg portion, a rear leg portion and a back portion. The side frames having a plurality of openings therein the have a flange that extend into the openings, the openings sized and shaped to receive planks from a first side and end caps from a second side. The end caps include a step that is sized and shaped to receive the flanges in the openings thereby preventing the planks from being pulled through the openings. The benches can be themed by making the side frames one color and the end caps another color and by adding an emblem to a recessed panel in the side frames. As such an improved bench that is easy to assemble, that can be customized and that has a long useful life is presented.

DETAILED DESCRIPTION OF THE INVENTION

Figure 1:
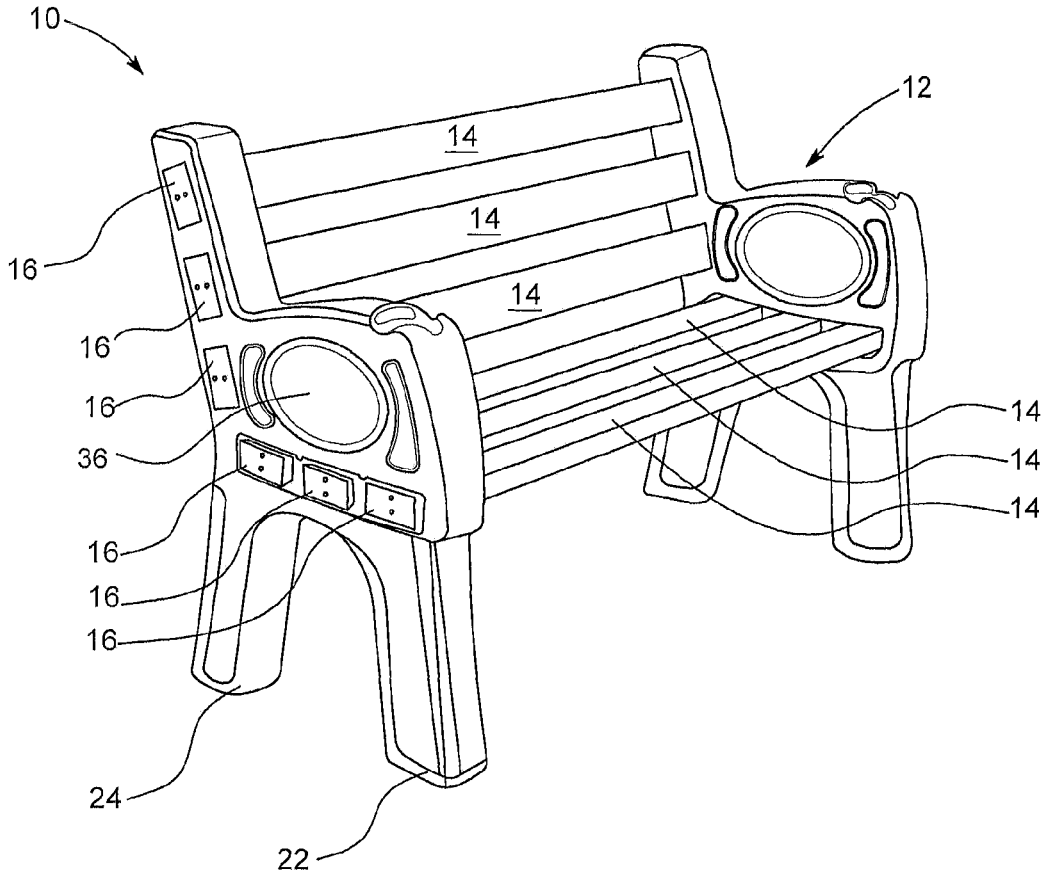
FIG. 1 is a perspective view of an improved bench system, the view showing a pair of side frames in opposing parallel spaced relation, with a plurality of planks that connect to the side frames and are inserted into openings in the side frames, end caps are connected to the ends of the planks, thereby holding the planks within the openings, the view also showing an emblem positioned within the center recessed panel of the side frame.
Figure 2:
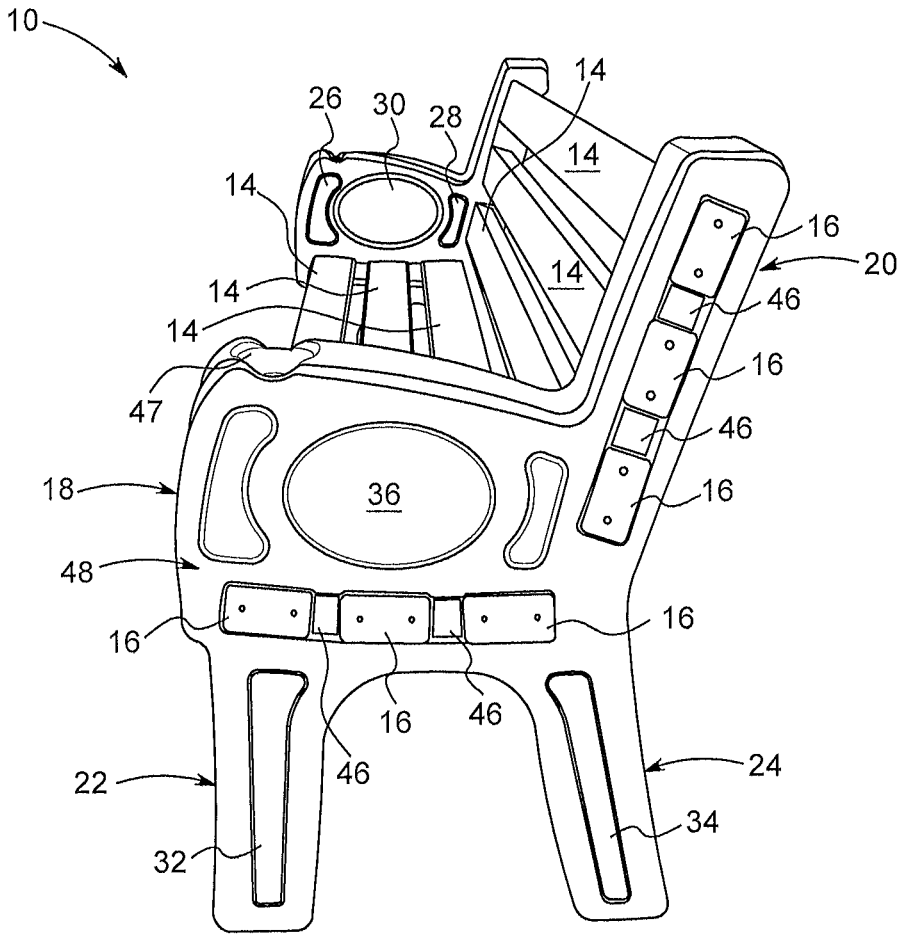
FIG. 2 is another perspective view of the improved bench system of FIG. 1.
Figure 3:
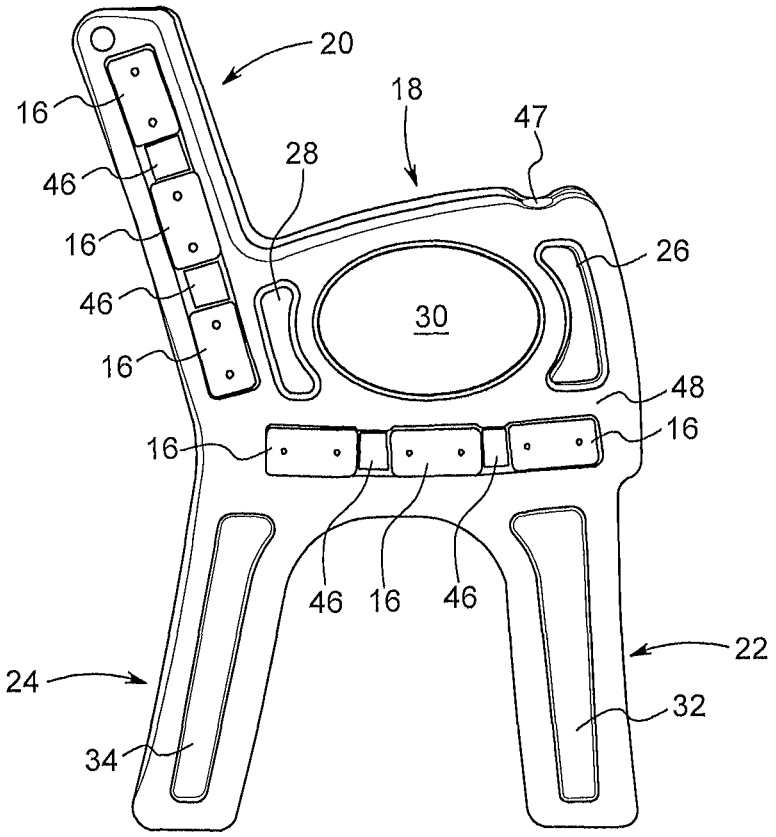
FIG. 3 is a side elevation view of the improved bench system of FIG. 1.
Figure 4:
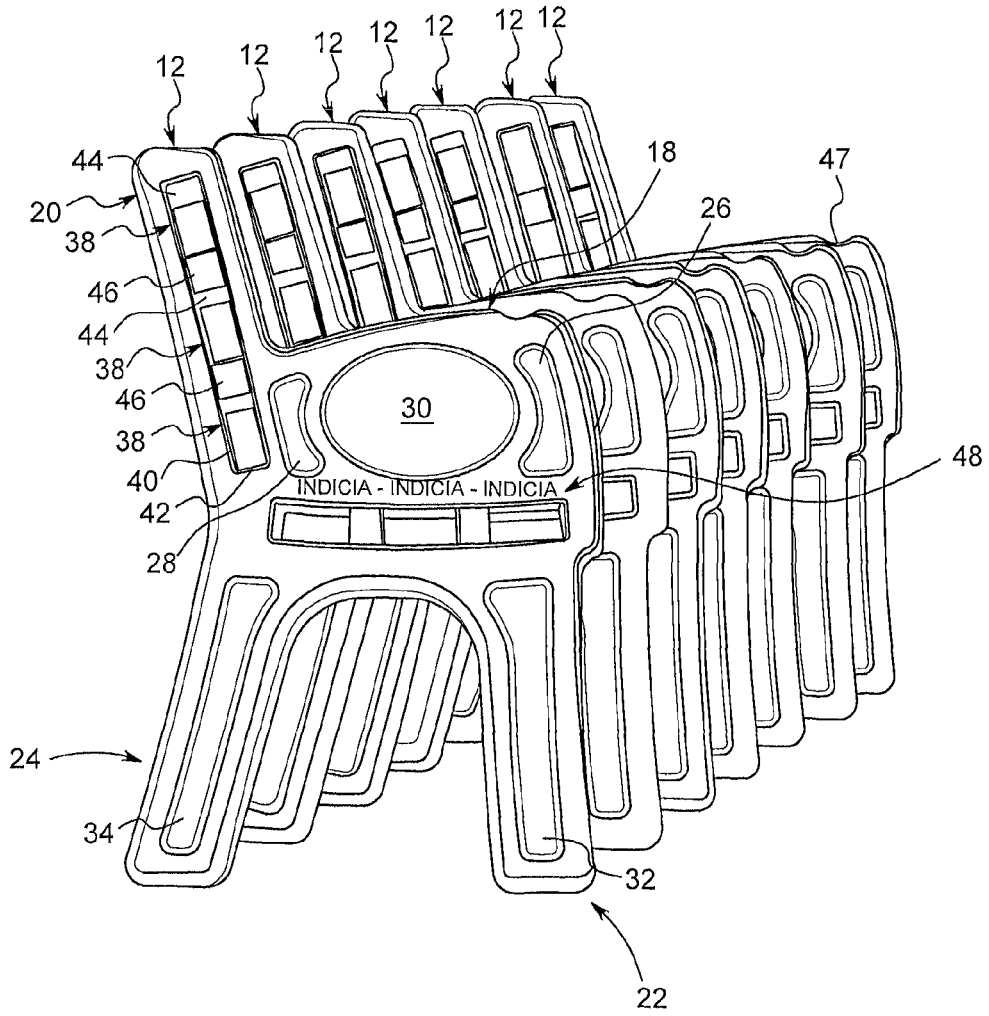
FIG. 4 is a side perspective view of a plurality of side frames of the improved bench system of FIG. 1.
Figure 5:
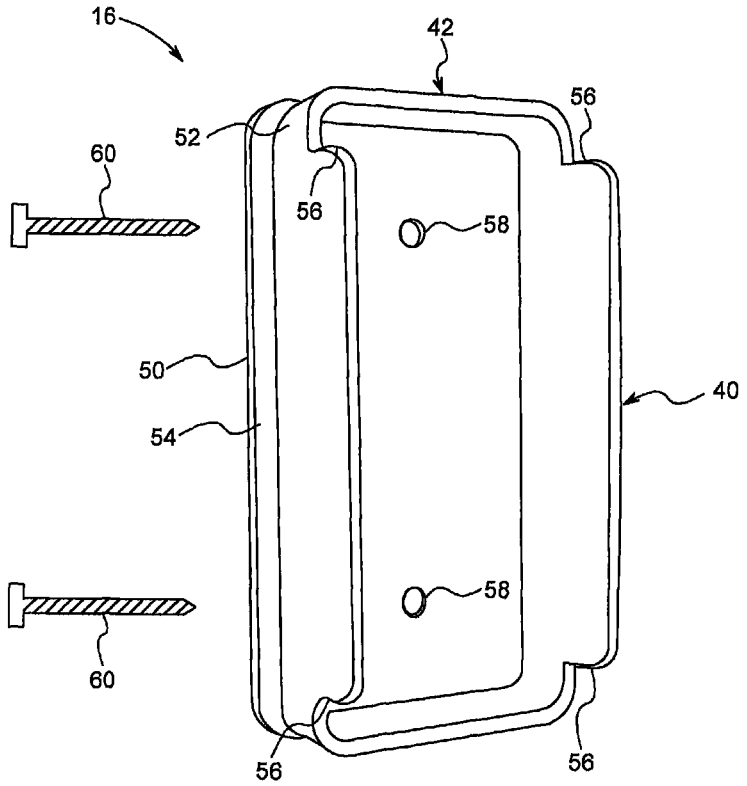
FIG. 5 is a perspective view of the inside surfaces of an end cap of the improved bench system of FIG. 1, the view showing the inside surface of the exterior wall, the collar, the recessed step and the cavity that receives the end of the plank.

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the invention(s). The following detailed description is, therefore, not to be taken in a limiting sense, and the scope of the invention(s) is defined only by the appended claims, along with the full scope of equivalents to which such claims are entitled.

As used herein, the terminology such as vertical, horizontal, top, bottom, front, back, end, sides and the like are referenced according to the views, pieces and figures presented. It should be understood, however, that the terms are used only for purposes of description, and are not intended to be used as limitations. Accordingly, orientation of an object or a combination of objects may change without departing from the scope of the invention.

With reference to the figures, a bench system 10 is presented. The bench 10 is formed of a pair of side frames 12 that hold a plurality of planks 14. An end cap 16 is connected to the outward ends of planks 14 thereby holding the planks 14 within side frames 12.

Side frames 12 are formed of any suitable size, shape or design. In one arrangement, as is shown, side frames 12 are formed of a single unitary piece or a monolithic piece of material that is either solid, partially or wholly hollow or includes solid portions and hollow portions. In one arrangement, side frames 12 are hollow and have a single open hollow interior 17 or cavity that extends throughout the interior of the side frames 12. This arrangement, having a hollow interior cavity, provides the side frames 12 with the greatest strength while utilizing the least amount of material. This arrangement also provides maximum strength at minimum weight. In addition, in one arrangement, the hollow interior cavity is sealed, thereby preventing water, dirt, bugs or other contaminants from entering the hollow interior cavity of side frames 12.

In the arrangement shown, when viewed from the top, bottom, front or back, side frames 12 are generally planar in shape, or have a planar exterior edge, meaning they have a generally constant width or thickness. However, as is further described herein, side frames also include a plurality of recesses therein that are visible when viewing the side frames 12 in a side or perspective view.

Side frames 12 include a main body portion 18, a back portion 20, a front leg portion 22 and a rear leg portion 24. Back portion 20 is formed of any suitable size, shape or design, and serves to provide support for a user's back. In the arrangement shown, back portion 20 is connected to the main body portion 18 at or near the rearward side of main body portion 18 and extends upward and slightly rearward therefrom at an angle.

Front leg portion 22 is formed of any suitable size, shape or design, and serves to provide support for the forward end of the bench system 10. In the arrangement shown, front leg portion 22 is connected to the main body 18 at or near the forward side of the main body portion 18 and extends downward and slightly forward therefrom at an angle.

Rear leg portion 24 is formed of any suitable size, shape or design, and serves to provide support for the rearward end of the bench system 10. In the arrangement shown, rear leg portion 24 is connected to the main body 18 at or near the rearward side of the main body portion 18 and extends downward and slightly rearward therefrom at an angle.

In one arrangement, as is shown, main body portion 18 includes a forward recess panel 26, a rearward recess panel 28 and a center recess panel 30. Similarly, front leg portion 22 includes a front leg recess panel 32 and rear leg portion 24 includes a rear leg recess panel 34. In the arrangement shown, forward recess panel 26, rearward recess panel 28, center recess panel 30, front leg recess panel 32 and rear leg recess panel 34 are generally flat and planar in shape are recessed a distance inward from the generally flat and planar outward most exterior sides of side frames 12. However, the opposite is hereby contemplated and panels 26, 28, 30, 32, 34 may protrude outward from the other portions of side frames 12 as well and serve the same purposes. In the arrangement shown, both sides of side frames 12 include these panels 26, 28, 30, 32, 34. That is, each side frame 12 includes these panels 26, 28, 30, 32, 34 on both an inside surface (the surface facing the opposing side frame 12) and an outside surface (the side facing away from the opposing side frame 12).

Forward recess panel 26, rearward recess panel 28, center recess panel 30, front leg recess panel 32 and rear leg recess panel 34 are formed of any suitable size, shape and design. Panels 26, 28, 30, 32, 34 both serve to provide an aesthetically pleasing look as well as provide additional structural rigidity to side frames 12. That is, by having forward recess panel 26, rearward recess panel 28, center recess panel 30, front leg recess panel 32 and rear leg recess panel 34 recess in from the exterior most planar surface of side frames 12 a distance this provides extra rigidity to side frames 12 in much the same way that corrugation provides additional strength to a flat sheet of material, such as in a hollow door, grain bin wall or a piece of cardboard.

In the arrangement shown, center recess panel 30 is generally round, circular or oval in shape and is generally centered vertically and horizontally within the side of main body portion 18. Forward recess panel 26 and rearward recess panel 28 are positioned on the forward side and rearward side of center recess panel 30, respectively, and have an arcuate inner edge that generally centers or frames the center recess panel 30 therein; whereas the outward edges and top and bottom edges of the forward recess panel 26 and rearward recess panel 28 generally mirror the exterior shape of main body portion 18.

Similarly, front leg recess panel 32 and rear leg recess panel 34 have a shape that generally mirror the exterior shape of front leg portion 22 and rear leg portion 24. That is they are generally rectangular in shape and extend from near the bottom of the leg portions 22, 24 and terminate near the bottom of main body portion 18 with a generally straight forward, rearward, bottom and top edges. The generally rectangular front leg recess panel 32 and rear leg recess panel 34 have an additional inwardly pointing curved edge that forms a generally triangular extension to the generally rectangular panels 32, 34 at the upper and inner edges thereof. This inwardly pointing curved edge portion positioned at the upper ends of the front leg recess panel 32 and rear leg recess panel 34 helps to fill some of the additional space formed by connection of the front leg portion 22 and rear leg portion 24 to the main body portion 18.

While forward recess panel 26, rearward recess panel 28, center recess panel 30, front leg recess panel 32, rear leg recess panel 34, are shown and described herein, any number of other recess panels are hereby contemplated for use, as is any shape to these or other recess panels.

The recessed nature of forward recess panel 26, rearward recess panel 28, center recess panel 30, front leg recess panel 32 and rear leg recess panel 34 are well suited to receive emblems, stickers, coloring or other ornamentation therein. In one arrangement, as is shown, an emblem 36 is formed of approximately the same size and shape of center recess panel 30 and is adhesively placed therein, printed there, painted therein or otherwise formed or placed therein. In this arrangement, the exterior edge of emblem 36 fits within the exterior edges of center recess panel 30 with close and tight tolerances. This arrangement ensures maximum life as the recess of center recess panel 30 partially protects emblem 36 and helps to prevent delamination over time.

In the arrangement shown, an emblem 36 is only placed in the center recess panel 30, however in an alternative arrangement, an emblem is placed in any or all of the other recess panels 26, 28, 32, 34. Emblems 36 may be themed with any design or color scheme, trademark, logo, image, picture, wording or any other decorative or informational features. In one arrangement, emblem 36 is themed with a logo, name and/or design of a sports team. In another arrangement, emblem 36 is themed with an outdoors scene, a farming scene, a landscape scene or similar scene or theme. In yet another arrangement, emblem 36 is themed with a commemorative event, such as the passing of a person, or a quote. In another arrangement, emblem 36 is themed with the name of a school or a family. In another arrangement, emblem 36 is themed with a patriotic scene such as a bald eagle and/or a flag. It is hereby contemplated that emblem 36 carries any other message or design or scene.

In one arrangement, side frames 12 are generally symmetric with respect to a plane that extends down their middle separating the right-side from the left-side of the side frames 12. In an alternative arrangement, side frames 12 are symmetric except for features (such as flanges 44) within openings 38 in side frames 12, as is further described herein.

A plurality of openings 38 extend through side frames 12 from the left side to the right side. Openings 38 are formed of any suitable size, shape and design and are positioned in any portion of side frames 12. In the arrangement shown, openings 38 are generally sized and shaped to receive a standard plank 14 of wood, such as a standard 2×4. This is desirable because 2×4s are widely available standard materials that can be purchased at any hardware store. Alternatively, openings 38 are sized and shaped to receive any other sized piece of material. To be clear, any number of openings 38 is hereby contemplated for use, and any size of opening 38 is hereby contemplated for use with any standard sized plank 14 or non-standard sized plank 14 or other piece of material.

In the arrangement shown, three openings 38 are positioned in spaced relation to one another extending from the front of side frame 12 to the back of side frame 12. These openings hold planks 14 that form the bottom or seat portion of bench system 10. These openings 38 are arranged such that the wider dimension of the planks 14 (the 4 inch portion) are generally horizontally aligned and the narrower dimension of the planks 14 (the 2 inch portion) are generally vertically aligned. These three horizontally aligned openings 38 are positioned at or near the bottom of main body portion 18 or at or near where the bottom of main body portion 18 joins with the top of front leg portion 22 and rear leg portion 24. In one arrangement, the three openings 38 are aligned in generally straight arrangement to one another thereby providing a generally flat sitting surface that is either horizontal in nature or aligned at a slight angle, either extending slightly upward or slightly downward as it extends forward or rearward. In another arrangement, to provide improved comfort, the three openings 38 that form the seat portion of bench 10 are aligned in slightly curved fashion to one another. In one arrangement, the three openings 38 form a seat portion of bench 10 that has a slightly concave upwardly facing arcuate curved seat, or alternatively the three openings 38 form a seat portion of bench 10 that has a slightly convex upwardly facing arcuate curved seat.

In the arrangement shown, three openings 38 are also positioned in the back portion 20. In one arrangement, as is shown, these three openings 38 in back portion 20 are positioned in spaced relation to one another extending from the bottom of back portion 20 to the top of back portion 20. These openings hold planks 14 that form the back of bench system 10. These openings 38 are arranged such that the wider dimension of the planks 14 (the 4 inch portion) are generally vertically aligned (or aligned mostly vertically but at a slight rearward angle as they extend upward) and the narrower dimension of the planks 14 (the 2 inch portion) are generally horizontally aligned (but again, aligned mostly horizontally but at a slight angle). These three horizontally aligned openings 38 are positioned at or near the middle of back portion 20. In one arrangement, these three openings 38 are aligned in straight arrangement to one another thereby providing a generally flat back portion that is either vertical in nature or angled slightly rearward as it extends upward. In another arrangement, to provide improved comfort, the three openings 38 that form the back portion of bench 10 are aligned to form a slightly convex forward facing surface.

Openings 38 are formed of any suitable size, shape and design to receive and hold the ends of planks 14 therein. In the arrangement shown, openings 38 are generally rectangular in shape and are sized and shaped to receive planks 14 therein with close and tight tolerances. That is, in the arrangement shown, openings have a pair of opposing wider sides 40 that are positioned in approximate parallel spaced alignment to one another, and a pair of narrower sides 42 that are positioned in approximate parallel spaced alignment to one another, wherein the wider sides 40 being placed in approximate perpendicular alignment to the narrower sides 42, thereby forming an approximate rectangular opening. In the arrangement shown, wherein a standard 2×4 is used as plank 14, the wider sides 40 correspond to the 4 inch side of the 2×4 and the narrower side 42 corresponds to the 2 inch side of the 2×4. In one arrangement, at least one flange 44 extends inward from one or more of the sides 40, 42 of opening 38. In the arrangement shown, a flange 44 extends the length of one or both narrower sides 40 and extends inwardly therefrom a distance. Flanges 44 serve as a stop or stop surface within openings 38 to prevent planks 14 from sliding through openings 38 when end caps 16 are installed thereon.

Side frames 12 also include a plurality of supports 46 that extend between and separate adjacent openings 38. Supports 46 define the exterior edge between adjacent openings 38. Like panels 26, 28, 30, 32, 34, supports 46 are slightly recessed to the exterior surface of side frames 12.

The upper surface of main body portion 18 terminates in a generally flat but arcuate surface that serves as an arm rest portion that extends from the back portion 20 before terminating at the forward side of bench system 10 above front leg portion 22. Side frames 12 also include a cup holder recess 47. Cup holder recess 47 is formed of any suitable size, shape and design. In the arrangement shown, cup holder recess 47 is positioned in the upper forward end of main body portion 18 of side frames 12 at the end of the arm-rest portion thereof. In the arrangement shown, cup holder recess 47 is a generally circular recess or depression in the side frame 12 that provides a generally flat and horizontally aligned bottom surface that provides a convenient place to position a drink thereon.

Side frames 12 also include indicia 48 thereon. Indicia 48 is any writing, words, numbers, marks or other insignias. In the arrangement shown, indicia 48 are positioned along the sides of side frames 12 at or near the bottom of main body portion 18, and above openings 38 and include the name of the manufacturer, the trademark for the product and the phone number for the manufacturer, as an example.

End caps 16 are connected to each plank 14 on the opposite side of side frames 12. End caps 16 are formed of any suitable size, shape and design. In their simplest form, end caps 16 include a feature or surface that is dimensionally larger than openings 38 such that when end caps 16 are connected to the end of planks 14 the planks 14 cannot be pulled through the openings.

In the arrangement shown, as one example, end caps 16 have a generally flat and planar exterior wall 50 that is generally rectangular in shape. Exterior wall 50 is generally slightly oversized to the cross-sectional size and shape of planks 14. That is, when conventional 2×4s are use, exterior wall 50 mirrors the size of the 2×4 but is slightly larger to provide clearance for dimensional variability of planks 14. A collar 52 extends inward from the interior side of exterior wall 50 a distance.

In the arrangement shown, like exterior wall 50, collar 52 has a generally rectangular shape. However, the exterior periphery of collar 52 is slightly smaller than the exterior periphery of exterior wall 50. As such, a portion or lip 54 of exterior wall 50 extends past the exterior surface of collar 52. The interior surface of collar 52 defines a cavity 55 that is sized and shaped to receive the end of plank 14 therein. That is, in the example of plank 14 being a 2×4, the interior surface of collar 52 is sized and shaped to receive the end of the 2×4 with close and tight tolerances. When plank 14 is inserted within cavity 55, the end of plank 14 is in flat and flush engagement with the inside surface of exterior wall 50. Similarly, when plank 14 is inserted within cavity 55, the outside surface of plank 14 adjacent the end of plank 14 is in flat and flush engagement with the inside surface of collar 52 which extends around the end of plank 14.

Collar 52 also includes a step 56 therein. That is, the step portion 56 is a cut-out portion of collar 52 that is sized and shaped to provide clearance for or to receive the flanges 44 of openings 38 of side frames 12 when bench 10 is assembled. In the arrangement shown, steps 56 are positioned in the narrower sides 42 of end caps 16 to correspond with the flanges 44 being positioned in the narrower sides 42 of openings 38, however the opposite arrangement is hereby contemplated where flanges 44 and steps 56 are placed in the wider sides 40. Where steps 56 are not present, collar 52 extends inward from exterior wall 50 a greater distance.

One or more through holes 58 are positioned in the exterior wall 50 of end cap 16. Through holes 58 are sized and shaped to receive conventional fasteners 60 such as screws or bolts. In the arrangement shown, a pair of through holes 58 are shown, one positioned at or near each outward end of end cap 16. This positioning helps to prevent rotation of plank 14 when end caps 16 are fastened with conventional fasteners 60 to planks 14. In one arrangement, through holes 58 are counter-sunk so that the exterior surface of fasteners 60 are in flat and flush alignment with the exterior surface of exterior wall 50 when installed thereby providing an improved flat and smooth appearance.

Assembly:

Bench system 10 is assembled by any means known in the art. As one example, a pair of side frames 12 are positioned in approximate parallel spaced relation to one another. Next, planks 14 of equal length are inserted, one into each of the interior sides of the openings 38. Next, end caps 16 are installed onto the ends of planks 14 by inserting end caps 16 into the exterior sides of openings 38. Care is taken to align the end caps 16 properly and fully insert them into the openings 38.

In the arrangement where no flange 44 is present within opening 38, end cap 16 is fully inserted and installed when the lip 54 of end cap 16 engages the exterior surface of opening 38, or a step 55 of opening 38 that is sized and shaped to receive lip 54 therein. As is shown, as one example in FIG. 6, when the lip 54 of end cap 16 engages the step 55 of opening 38, the exterior surface of exterior wall 50 is in generally flat and flush alignment with the exterior surface of side frame 12.

In the arrangement where one or more flanges 44 are present within openings 38, end cap 16 is fully inserted and installed when the interior edge of step 56 engages the exterior surface of flange 44 of the opening 38.

In the arrangement where one or more flanges 44 are present within openings 38 and openings include a step 55, end cap 16 is fully inserted and installed when the interior edge of step 56 engages the exterior surface of flange 44 of the opening 38 and the lip 54 of end cap 16 engages the exterior surface of opening 38, or step 55 of opening 38 that is sized and shaped to receive lip 54 therein.

Figure 6:
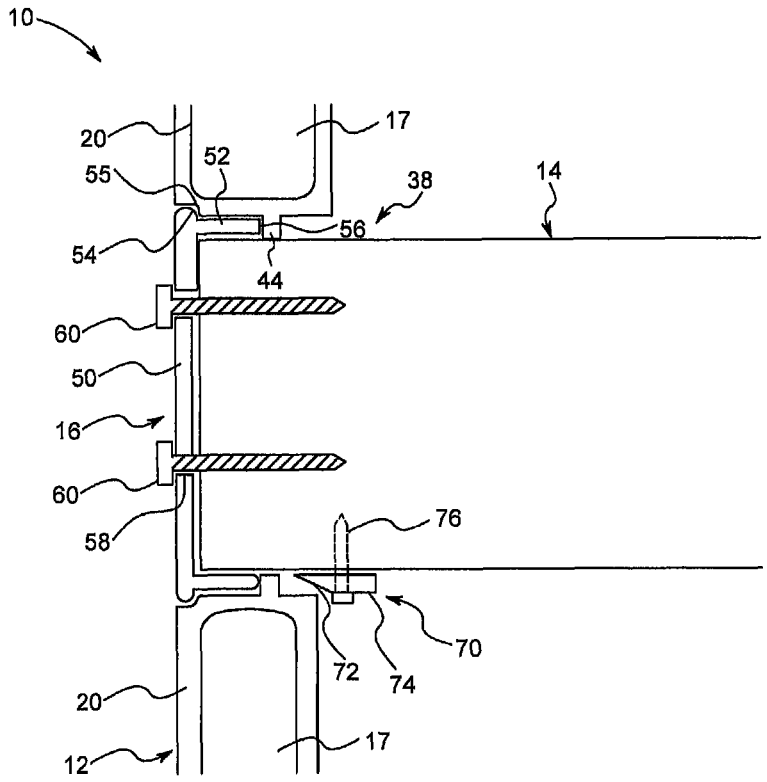
FIG. 6 is a side elevation cut-away close-up view of a plank inserted within an opening of a side frame, the view showing the end of the plank positioned within the cavity of the end cap, the view showing the end cap engaged with a step or flange of the side frame thereby preventing the end cap from pulling through the opening, the view also showing a stop connected to the plank adjacent the inside surface of the side frame, opposite the end cap, thereby preventing the side frame from sliding inward along the plank.
Figure 7:
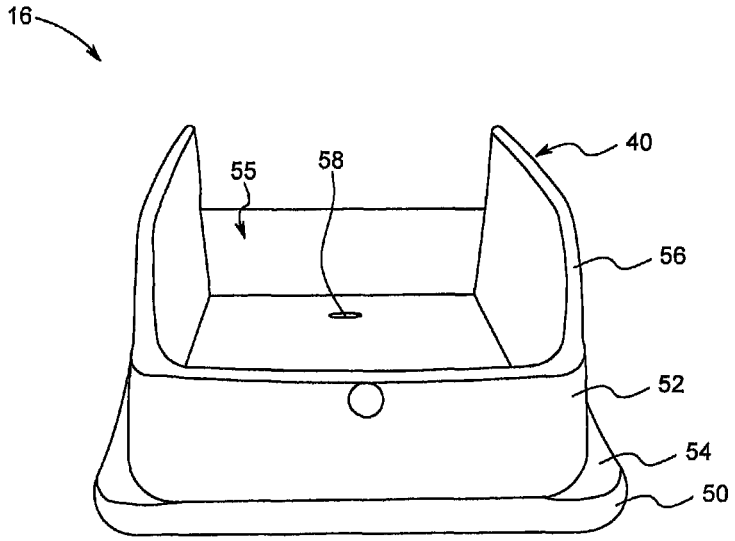
FIG. 7 is another perspective view of the inside surfaces of an end cap of the improved bench system of FIG. 1, the view showing the inside surface of the exterior wall, the collar, the recessed step and the cavity that receives the end of the plank.

In the arrangement shown in FIG. 6, when fully inserted within opening 38, the exterior surface of exterior wall 50 is in generally flat and flush alignment with the exterior surface of side frame 12.

The end plank 14 is fully received within the cavity 55 formed by the interior surface of exterior wall 50 and the interior surface of collar 52. In this position, the end of plank 14 is flush with the interior surface of exterior wall 50 and flush with the interior surface of collar 52. Once in this position, fasteners 60 are inserted into through holes 58 and into planks 14 and the end cap 16 is tightened against the end of plank 14 thereby pulling the end of plank 14 into the cavity 55 of end cap 16.

In this position, the planks 14 are tightly and firmly held in place by the combination of the fasteners 60 extending through the end caps 16, and the lip 54 and step 56 of end cap 16 engaging the side frames 12 in such a way that they cannot pull through the opening 38 or move with respect to the side frames 12. As such, a strong, rigid and easily assembled, a do-it-yourself bench 10 is made without the use of any special tools, without having to make any precision cuts.

Method of Manufacture:

The side frames 12 and end caps 16 of bench system 10 are formed in any suitable manner. In one arrangement, these parts are injection molded, blow molded, rotationally molded (or "roto molded"), or molded by any other manner, out of a plastic, nylon, or any other composite material. Alternatively, any other manner or method or manufacture is hereby contemplated for manufacture of these parts.

Design:

It is hereby contemplated that side frames 12, end caps 16 and emblems 36 are formed of any colors. That is, to provide a unique and aesthetically pleasing appearance, side frames 12 are formed of one color, and end caps 16 are formed of a second color. As one example, when making an University of Iowa Hawkeyes themed bench, whose school colors are black and yellow, the side frames 12 are formed of a black material and the end caps 16 are formed of a yellow material and the emblem 26 is printed in black and yellow with the symbol of the Iowa Hawkeyes and installed within center recess panel 30 of side frames 12. Any other color scheme or design is hereby contemplated for use.

To ensure a long life and to prevent fading from the sun, a UV stabilizer is mixed in with the mixture forming the components of the bench 10.

Stops:

In one arrangement, to provide additional assurances that side frames 12 are not moveable inward toward one another along the length of planks 14, one or more stops 70 are utilized. Stops 70 are formed of any suitable size, shape and design and serve to stop or prevent any inward movement of side frames 12 along planks 14.

In one arrangement, as is shown, one or more stops 70 are positioned at the interface between side frames 12 and planks 14 on a side opposite end caps 16. That is, one or more stops 70 are positioned on the inward side of side frames 12, to prevent the inward movement of side frames 12 relative to planks 14, whereas end caps 16 are positioned on the outward side of side frames 12 to prevent outward movement of side frames 12.

In one arrangement, as is shown in FIG. 6, stop 70 includes an angled or wedge surface 72 that is connected to a trailing elongated tab portion 74. In this arrangement, stop 70 is placed in engagement with both the side frame 12 and plank 14 by placing or wedging wedge surface 72 into the gap between plank 14 and side frame 12 thereby taking up any dimensional variability between opening 38 and the end of plank 14.

Once installed in this manner, stop 70 is affixed to side frame 12 and/or plank 14 by any manner, method or means. As one example, a fastener 76, such as a pin, screw, bolt, nail, staple or the like, is passed through the tab portion 74 of stop 70 and into plank 14. In another arrangement, stop 70 is adhered to side frame 12 and/or plank 14 by glue, two-sided tape, or any other adhesive. In another arrangement, stop 70 includes teeth or other gripping members that hold stop 70 in place once inserted.

In one arrangement, one or more stops 70 are installed on each end of each plank 14. In one arrangement, stops 70 are placed at the narrow sides 42 of planks 14 so as to prevent interference with upper surface or forward surface of the seat portion or back portion. In another arrangement, stops 70 are placed on the bottom side of the seat portion and/or the back side of the back portion so as to prevent interference upper surface or forward surface of the seat portion or back portion. In yet another arrangement, stops 70 are placed on the top side of the seat portion and/or the front side of the back portion.

Figure 8:
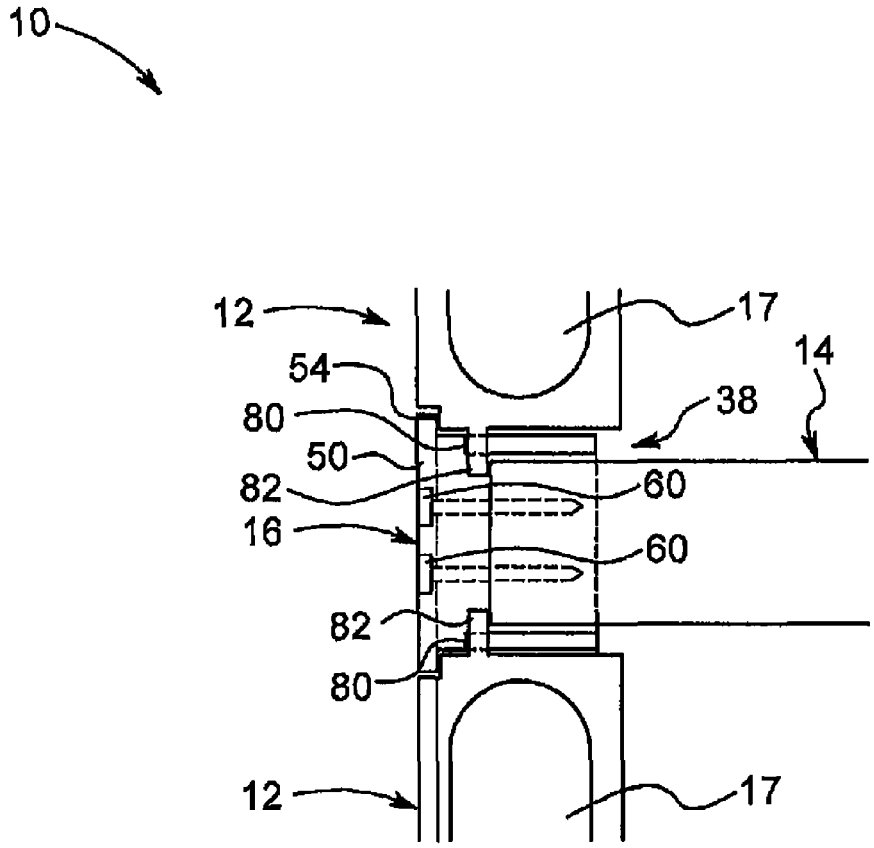
FIG. 8 is a side elevation cut-away close-up view of a plank inserted within an opening of a side frame, the cut-away is made vertically through a slot positioned in the end cap that allows room for a flange or other stop feature within the opening, the view showing the plank engaged with the flange or stop feature on one side and the slot in the end cap engaged with the other side of the flange or stop feature, thereby locking the side frame between the end cap and the end of the plank.

Slot & Stop Member:

In another arrangement, with reference to FIG. 8, end caps 16 and openings 38 are designed to sandwich a portion of side frame 12 there between. In the arrangement shown, as one example, end cap 16 includes a slot 80 that provides room for support member 80 of side frame 12 to extend therein. That is, slot 80 and support member 82 are sized and shaped such that when end cap 16 is inserted into the exterior side of opening 38 slot matingly receives support member 82 therein and the end of plank 14 is inserted into the interior side of opening 38 until it engages support member 82 as well as the cavity 55 of end cap 16.

Once end cap 16 is fully inserted into opening 38 on one side and the end of plank 14 is inserted in the other side, support member 82 is sandwiched between the end cap 16 and plank 14. Once in this position, fasteners 60 are passed through end cap 16 and into plank 14 thereby pulling the two components into tight locking arrangement around support member 82. This arrangement ensures that the side frame 12 is locked around the support member 82. While support members 82 are shown as a post that extends into the slot 80 of end cap 16, any other form of a device is hereby contemplated for use as support member 82 which is locked between end cap 16 and plank 14.

From the above discussion it will be appreciated that the bench system 10 and manufacturing method and method of assembly shown and described herein improves upon the state of the art.

Specifically, the bench presented herein improves upon the state of the art; is easy to assemble; is safe to use; is durable over time; resists decay and deterioration from the elements over time; resists fading; is fun to assemble; is simple and not intimidating to assemble; uses standard parts and pieces; is appealing for do-it-yourselfers; can be themed after a sports team or other thing or event; is inexpensive to manufacture; has an intuitive design; can be personalized; has a long useful life, among countless other features or advantages.

It will be appreciated by those skilled in the art that other various modifications could be made to the device without parting from the spirit and scope of this invention. All such modifications and changes fall within the scope of the claims and are intended to be covered thereby.

What is claimed is:

1. An improved bench system, comprising:

a pair of side frames positioned in opposing spaced relation to one another;

the side frames having a plurality of openings that extend through the side frames;

a first plank extending a length between opposing ends;

wherein ends of the first plank are positioned within first openings of the opposing side frames;

an end cap inserted into the first openings of the side frames on a side opposite the first plank;

the end cap fastened to ends of the plank by at least one fastener;

wherein the at least one fastener extends through the end cap and into the first plank thereby pulling the first plank and the end cap into frictional engagement with one another;

wherein the end caps include a stop surface that engages a surface of the side frames thereby preventing the end caps from pulling through the openings.

2. The bench of claim 1 wherein the side frames are blow molded, rotationally molded or injected molded.

3. The bench of claim 1 wherein the side frames are formed of a single unitary piece.

4. The bench of claim 1 wherein the side frames have a recess panel therein and an emblem attached to the recess panel to provide ornamentation to the bench.

5. The bench of claim 1 wherein the side frames are formed of one color and the end caps are formed of a second color.

6. The bench of claim 1 wherein the stop surface of the end caps include a lip that engages a stop surface of the side frame when installed on the side frame, wherein engagement of the lip of the end cap and the stop surface of the side frame prevents the plank from pulling out of the opening.

7. The bench of claim 1 wherein the end cap includes a step that corresponds with a flange in the opening.

8. An improved bench system, comprising:

a pair of side frames positioned in opposing spaced relation;

the side frames having a main body portion, a back portion, a front leg portion and a rear leg portion;

the side frames having a plurality of plank openings, the plurality of plank opening configured to receive ends of a plank;

a first plank extending a length between opposing ends;

the ends of the first plank inserted in a first side of a first plank opening in the opposing side frames;

a pair of end caps having an exterior wall having an exterior facing surface and an interior facing surface, sidewalls that extend inward from the exterior wall that form a cavity, wherein the cavity is configured to receive an end of the first plank;

the end caps inserted in a second side of the first plank openings, wherein the second side of the first plank openings, is opposite the first side of the first plank openings;

wherein an end of the first plank is inserted within the cavity one of the end caps;

wherein the end caps are fastened to the respective ends of the first plank by one or more fasteners that extend through the end cap and into the first plank thereby pulling the first plank and the end cap into frictional engagement with one another;

the end caps having a stop surface that engages a surface of the side frames, thereby preventing the end cap from pulling through the opening.

9. The bench of claim 8 wherein the end cap includes a step that engages a flange extending into the plank opening of the side frame.

10. The bench of claim 8 wherein the side frames are blow molded, rotationally molded or injection molded.

11. The bench of claim 8 wherein the side frames are formed of a first color and the end caps are formed of a second color.

12. The bench of claim 8 further comprising a plurality of planks, wherein a pair of end caps are fastened to each plank by passing at least one fastener through the exterior wall of an end cap into an end of each plank.

13. The bench of claim 8 further comprising a recessed portion in a side of the side frame and an emblem attached to the recessed portion.

14. The bench of claim 8 wherein the first plank is a 2×4.

15. A method of forming an improved bench system, the steps comprising:

providing a pair of side frames:

wherein the side frames include a front leg portion, a rear leg portion and a back portion;

wherein the side frames have a plurality of openings therein;

providing a plurality of planks;

wherein the planks extend a length between opposing ends;

providing a plurality of end caps;

wherein the plurality of end caps include an exterior wall having an exterior facing surface and an interior facing surface, and sidewalls that extend inward from the exterior wall that form a cavity;

wherein the cavity of the end caps is configured to receive an end of a plank;

wherein the end caps are configured to fit within the openings of the side frames;

inserting the ends of a first plank within a first side of a first opening of the side frames;

attaching an end cap to the ends of the first plank on a second side of the first opening of the side frames, such that the end of the first plank is positioned within the cavity of the end cap;

fastening the end cap to the first plank by passing at least one fastener through the exterior wall of the end cap and into the first plank thereby pulling the first plank and the end cap into frictional engagement with one another.

16. The method of claim 15 wherein a stop surface of the end caps engage a portion of the opening thereby preventing the end cap from pulling through the opening.

17. The method of claim 15 further comprising the step of attaching an emblem to the side frame members.

18. The method of claim 15 further comprising the steps of:

inserting the ends of a second plank within a first side of a second opening of the side frames;

attaching an end cap to the ends of the second plank on a second side of the second opening of the side frames.

19. The method of claim 15 further comprising locking a support member between the end caps and the ends of the planks.

* * * * *